US011558702B2

(12) United States Patent
Hildebrand et al.

(10) Patent No.: US 11,558,702 B2
(45) Date of Patent: Jan. 17, 2023

(54) RESTRICTING HEARING DEVICE ADJUSTMENTS BASED ON MODIFIER EFFECTIVENESS

(71) Applicant: SONOVA AG, Staefa (CH)

(72) Inventors: Nicola Hildebrand, Uster (CH); Volker Kuehnel, Maennedorf (CH); Michael Boretzki, Rueti (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/370,881

(22) Filed: Jul. 8, 2021

(65) Prior Publication Data

US 2022/0021993 A1 Jan. 20, 2022

(30) Foreign Application Priority Data

Jul. 16, 2020 (EP) ..... 20186216

(51) Int. Cl.
*H04R 25/00* (2006.01)

(52) U.S. Cl.
CPC ..... *H04R 25/70* (2013.01); *H04R 25/305* (2013.01); *H04R 25/50* (2013.01); *H04R 2225/55* (2013.01)

(58) Field of Classification Search
CPC ..... H04R 25/00; H04R 25/30
See application file for complete search history.

(56) References Cited

U.S. PATENT DOCUMENTS 6,201,875 B1 * 3/2001 Davis ..... H04R 25/70 381/314
6,840,908 B2 1/2005 Edwards
7,366,307 B2 4/2008 Yanz
8,208,667 B2 6/2012 Sorgel et al.
11,438,713 B2 * 9/2022 Udesen ..... H04R 25/554
2004/0071304 A1 4/2004 Yanz
(Continued)

FOREIGN PATENT DOCUMENTS

EP 0349835 1/1990
EP 1744590 1/2007
(Continued)

OTHER PUBLICATIONS

"Extended European Search Report received in EP Application No. 21182228.3 dated Apr. 8, 2022".

*Primary Examiner* — Suhan Ni
(74) *Attorney, Agent, or Firm* — ALG Intellectual Property, LLC

(57) ABSTRACT

A method for fitting a hearing device comprises: receiving an audio signal in the hearing device; providing a user interface for inputting at least one modifier value into the fitting device, the modifier value indicating, how a sound property of the audio signal should be modified by the hearing device; processing the audio signal with a sound processor of the hearing device in dependence of the at least one modifier value, thus providing a processed audio signal; outputting the processed audio signal to a user of the hearing device; determining an modifier effectiveness value based on the audio signal, the modifier effectiveness value indicating how much a change of the at least one modifier value results in a perceptible change of the processed audio signal output to the user; and restricting the inputting of the at least modifier value in dependence of the modifier effectiveness value.

12 Claims, 3 Drawing Sheets

(56) References Cited

U.S. PATENT DOCUMENTS

| | | | | |
|---|---|---|---|---|
| 2007/0009126 | A1 | 1/2007 | Fischer | |
| 2008/0019547 | A1 | 1/2008 | Baechler | |
| 2010/0067722 | A1* | 3/2010 | Bisgaard | H04R 25/70 381/314 |
| 2015/0281862 | A1 | 10/2015 | Wessel et al. | |
| 2016/0150330 | A1 | 5/2016 | Niederberger | |
| 2017/0127201 | A1 | 5/2017 | Roeck | |
| 2018/0352351 | A1 | 12/2018 | Yoo | |
| 2019/0253817 | A1 | 8/2019 | Callaway | |

FOREIGN PATENT DOCUMENTS

| | | |
|---|---|---|
| EP | 2023668 | 2/2009 |
| EP | 2031900 | 3/2009 |
| EP | 1973377 | 4/2011 |
| EP | 1601232 | 11/2011 |
| WO | 2005096732 | 10/2005 |
| WO | 2008009142 | 1/2008 |
| WO | 2013114337 | 8/2013 |

* cited by examiner

RESTRICTING HEARING DEVICE ADJUSTMENTS BASED ON MODIFIER EFFECTIVENESS

RELATED APPLICATIONS

The present application claims priority to EP Patent Application No. 20186216.6, filed Jul. 16, 2020, the contents of which are hereby incorporated by reference in their entirety.

BACKGROUND INFORMATION

Hearing devices are generally small and complex devices. Hearing devices can include a processor, microphone, speaker, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

Before a hearing device and in particular hearing aids are used, these devices may be fitted to the needs of the user. In general, fitting is the adaptation of a hearing device to the long-term properties, hearing and/or usage preferences and/or situation specific hearing activities to the user of the hearing device. Fitting may be performed by a user of the hearing device and/or a hearing care specialist.

Fitting with real-life sounds or artificial sounds, such as favorite music, which are known by the user and unknown by the fitting system, may have a high potential in individualization of the hearing device towards specific hearing activities, comfort of this sounds.

However, fitting with sounds which are unknown by the fitting system may have disadvantages, since wrong parts and/or wrong parameters of the hearing device may be adjusted. This may result in the situation that a user may perceive no audible differences. If the user of the hearing device makes this experience, he/she may lose confidence and may never use the corresponding control anymore. If a hearing care specialist fits the wrong part of the hearing device and/or wrong parameters, the changes will not be audible by the user in real life and may lead to negative changes for other situations.

In EP 2 023 668 A2 a hearing aid is shown, which is also able to analyze or classify the current hearing situation. The hearing aid can send reference data to a remote control with regard to one or more psychoacoustic dimensions, so that a display can be scaled specifically for the hearing situation. The reference data also can be used to give the user hints to the range in which the respective acoustic variable can actually be changed in the hearing situation.

EP 1 601 232 B1 describes a hearing aid, which offers the user a large number of manual setting options. For this purpose, different setting functions are automatically assigned to the operating elements as a function of the acoustic environment in which the hearing aid is currently located. By programming the hearing aid device, it can be determined which setting functions are assigned to an operating element in the respective hearing situation.

In US 2004 071304 A1 fitting of a hearing device is described, which includes adjusting a plurality of sliders on a display, where each slider represents a different parameter for fitting the hearing device. Limits or constraints used in a graphical interfaces are controlled by the system providing the display of these graphical interfaces. The limits or constraints are effectively set by an authorized user, such as an administrator, using the graphical interfaces provided by the application program.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
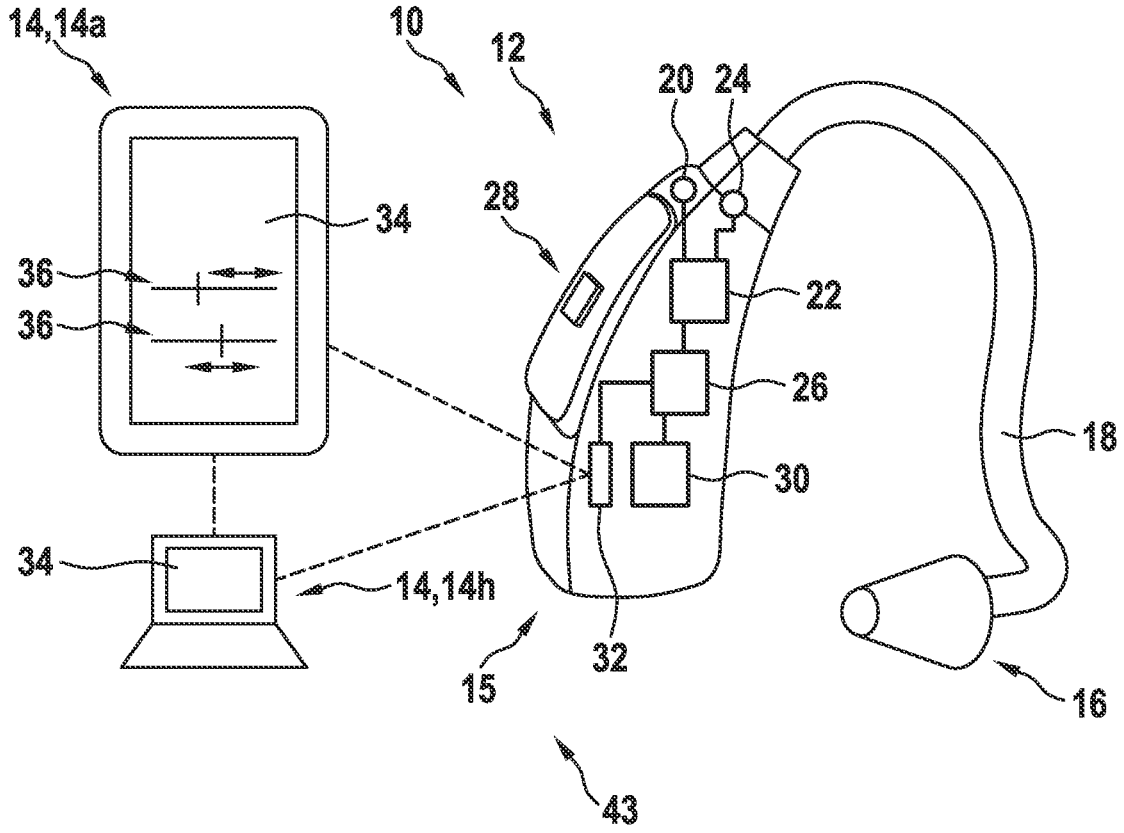
FIG. 1 schematically shows a fitting system according to an embodiment.

Described herein are a method, a computer program and a computer-readable medium for fitting a hearing device. Furthermore, the embodiments described herein relate to a fitting system.

It is a feature of the present invention to provide an effective fitting method and system, resulting in changes, which are perceptible to the user. A further feature is to increase the chance that the correct parts and/or parameters of the hearing device are fitted. An even further feature is to reduce the risk for miss tuned hearing devices.

These features are achieved by the principles described herein.

A first aspect relates to a method for fitting a hearing device with a fitting device. The hearing device may be carried by a user, for example behind and/or in his or her ear. The hearing device may be a hearing aid carried by the user behind the ear and/or in the ear.

The hearing device may be a hearing aid for compensating a hearing loss of a user. Here and in the following, when to a hearing device is referred, also a pair of hearing devices, i.e. a hearing device for each ear of the user, may be meant. A hearing device may comprise one or two hearing aids and/or a cochlear implant.

According to an embodiment, the method comprises: receiving an audio signal in the hearing device The audio signal may be generated by a microphone of the hearing device and/or may be received via a data communication connection, for example from a mobile device of the user of the hearing device.

According to an embodiment, the method further comprises: providing a user interface for inputting at least one modifier value into the fitting device, the modifier value indicating, how a sound property of the audio signal should be modified by the hearing device. The user interface may be provided by the fitting device and/or may be a control element of a graphical user interface, such as a slider. The modifier value may characterize a strength of a change of a sound property, such as bass, treble, noise clearness, etc. A sound property may be a perceptible property of the audio signal There may be one or more modifiers of the hearing device, for each of which one or more modifier values are stored in the hearing device. For example, for the modifier "overall volume", the modifier value may be a value indicative of the overall volume. The modifiers may be adjusted (and/or fitted) by the user of the hearing device and/or a hearing care specialist. For example, the modifier also may be a curve, which may be set by a hearing care specialist, such as a gain curve. A modifier value may be a point of such a curve, such as a frequency depended gain.

According to an embodiment, the method further comprises: processing the audio signal with a sound processor of the hearing device in dependence of the at least one modifier value, thus providing a processed audio signal. The sound processor may be configured with a set of parameters, which control the processing of the audio signal, such as level and/or frequency dependent attenuation, compressing of frequencies, noise canceling, etc. The parameters depend on the modifier value and therefore also the processing of the audio signal.

According to an embodiment, the method further comprises: outputting the processed audio signal to a user of the hearing device. The processed audio signal may be output by an output device of the hearing device, such as a loudspeaker of the hearing device or a cochlear implant.

According to an embodiment, the method comprises: determining a modifier effectiveness value based on the audio signal, the modifier effectiveness value indicating how much a change of the at least one modifier value results in a perceptible change of the processed audio signal output to the user. The modifier effectiveness value may indicate, how strong the modifier value influences the processing of the audios signal. As explained above, the modifier values is used for determining and/or adjusting control parameters of the sound processor and therefore can influence the processing of the audio signal. This depends on the current sound properties of the audio signal. When a sound property is present, which is modified by the modifier (such as noise for a noise modifier or bass for a bass modifier), then the modifier influences the processing of the audio signal. This is not the case, when the sound property is currently not present. For example, a bass modifier will not change the processing of the audio signal.

A lower modifier effectiveness value may indicate that the modifier modifies the audio signal weaker. A higher modifier effectiveness value may indicate that the modifier modifies the audio signal stronger. The modifier effectiveness value may be determined from the audio signal directly or indirectly. For example, the audio signal may be analyzed, whether the modifier would modify it, when its influence on the sound processor is considered. The modifier effectiveness value also may be determined from other quantities calculated in the hearing device from the audio signal. For example, the modifier effectiveness value may be provided by and/or derived from a classifier of the hearing device, actuator parameters of the hearing device and/or may be determined from settings of sound programs of the hearing device (see below).

According to an embodiment, the modifier effectiveness value is determined by processing the audio signal with the currently set modifier value producing a first processed audio signal and with a further modifier value producing a second processed audio signal. The further modifier value may have been input into the user interface or may have been selected automatically, for example being higher or lesser than the currently set modifier value. The modifier effectiveness value then may be determined by comparing the first processed audio signal and the second processed audio signal. For example, an integral of their difference may be used as the modifier effectiveness value. In general, the hearing device and/or more general the fitting system may simulate the effect of a changed modifier value to the sound processing of the hearing device.

There may be a perceptible change of the processed audio signal output, when the processed audio signal output, which depends on the actual modifier value, is different from another processed audio signal output, which would be determined based on the changed modifier value. Two audio signals may be perceptible different, when their integrated difference is higher than a threshold. It also may be that a spectra is determined for each audio signal and that the difference of the spectra is integrated. The two audio signals are then perceptible different, when the integration result is higher than a threshold. The spectra may be averaged over time before the delta calculation (moving average). The perceptual difference may be determined by a neural network that was previously trained with sample signals and difference assessments from people.

The modifier effectiveness value may be determined by the hearing device and/or by the fitting device, which fitting device is in data communication with the hearing device. In the first case, the modifier effectiveness value may be sent from the hearing device to the fitting device. In the second case, the audio signal, settings of the one or more sound programs, parameters of the actuators and/or the modifier values may be sent from the hearing device to the fitting device.

According to an embodiment, the method further comprises: restricting the inputting of the at least modifier value in dependence of the modifier effectiveness value. The modifier value may be input and/or changed with the fitting device in dependence of user input into the user interface. In cases, when this is not desired, such an inputting and/or changing may be restricted with the method. The fitting device may restrict the changing of the modifier value in dependence of the modifier effectiveness value.

For example, the inputting and/or changing may be performed dependent on a user interface control element of the fitting device. For each or some of the modifiers, a control element may be presented on the user interface of the fitting device. When the modifier effectiveness value indicates that a change in a modifier associated with this modifier, would not result in a perceptible change of the processing of the audio signal, the inputting and/or changing of the modifier value may be restricted or even more inhibited.

The fitting device may be a mobile device carried by the user and/or the user input may be made by the user of the hearing device. The fitting device may be a stationary device of a hearing care specialist and/or the user input may be made by the hearing care specialist.

When this is possible, a changed modifier value may be determined from the user input. The changed modifier value may be sent from the fitting device to the hearing device. In the hearing device, the corresponding modifier value may be set to the changed modifier value, such that the audio signal is processed with the changed modifier value. Since with the method the changed modifier value solely is applied, when the fitting device allows this, the user will perceive a changed audio signal processing with respect to the changed modifier value.

According to an embodiment, the fitting device determines a threshold modifier effectiveness value. The threshold modifier effectiveness value may be stored in the fitting device with respect to the modifier of the modifier value, which should be changed. It also may be that the threshold modifier effectiveness value is determined from settings of the one or more sound programs and/or of further data produced in the hearing device, such as the classification values generated by the classifier.

The inputting/and or changing of the modifier value may be restricted, when the modifier effectiveness value of the at least one sound program is smaller or higher than the threshold modifier effectiveness value.

According to an embodiment, the user interface is configured, such that solely a modifier value selected from a predefined set of modifier values can be input. For example, this may be achieved with a slider. In this case, the inputting of the at least one modifier value is restricted by restricting the predefined set of modifier values to a subset of the set. As an alternative, the user interface is configured, such that solely a modifier value selected from a predefined range of modifier values can be input and that the inputting of the at least one modifier value is restricted by restricting the predefined set of modifier values to a subrange of the range.

For example, the control element of the user interface may be adapted, such that a smaller range of possible modifier values can be selected. A restricted range of selectable modifier values may be stored in the fitting device with respect to the corresponding modifier and the modifier effectiveness values.

According to an embodiment, the changing of the modifier value is inhibited by the fitting device, when the modifier effectiveness values indicates that a change of the modifier value will not result in a perceptible change of the processed audio signal. For example, this may be done, when the modifier effectiveness value of is smaller than the threshold modifier effectiveness value.

According to an embodiment, the inputting of the at least one modifier value is restricted by turning off the user interface for inputting the modifier value. For example, the control element of the user interface for the corresponding modifier may be deactivated, such that the modifier value cannot be changed.

According to an embodiment, the fitting device determines a minimal modifier value and/or a maximal modifier value in dependence of the modifier effectiveness value. The minimal modifier value and/or the maximal modifier value may define a subset or subrange of a predefined set or range of possible modifier values. Optionally, the minimal modifier value and/or the maximal modifier value may be determined in dependence of the classification values and/or further data and/or settings of the hearing device, such as settings of the sound programs, a mixing relation between sound programs, etc.

The modifier value may be restricted to being higher than the minimal modifier value and/or smaller than maximal modifier value. For example, the control element of the user interface for the corresponding modifier may be adapted, such that solely modifier values higher than the minimal modifier value and/or smaller than the maximal modifier value may be selected.

According to an embodiment, a set of possible modifier values is determined for which an input of them and/or change to them results in a perceptible change of the processed audio signal output to the user. When a modifier value input into the user interface is not in the set of possible modifier values, the fitting system outputs a warning message that a change of the at least one modifier value has no perceptible effect on the sound processing of the sound program.

For example, the set may be defined by the minimal modifier value and/or the maximal modifier value. When the actual modifier value is higher than the minimal value and/or smaller than the maximal value, the fitting system outputs a warning message that a change of the at least one modifier value has no perceptible effect on the sound processing. It also may be that the person, who is making the user input is warned that the change may have no or nearly no effect. The warning message may be output by the user interface of the hearing device and/or the fitting device.

As an example, it may be that the hearing device simulates the effect of a changed modifier value (see above) for one or more border values of the subset or subrange. The simulated output signal may be compared with the real output signal. In the case of more than one simulated output signals, the simulated output signals can be compared with each other. For example, the modifier for one of the simulated output signals is set to 50%, while the other one is set to 100%. If the output signals differ perceptually, the 50%-100% range is enabled, otherwise not. This also may be applied to finer subdivisions, e.g. 50-60%, 60-70% etc. and for example activate 0% to 60%. The modifier effectiveness value is accordingly determined based on specific sets, ranges and/or values of modifier values.

According to an embodiment, the fitting system outputs an alert message, when the modifier effectiveness value and the actual modifier value indicates that a changing of the modifier value results in a perceptible effect on the sound processing of the sound program. For example, one or more modifiers may be selected by the user (in particular a fitter) for which the alert message is generated. In such a way, situations may be identified, where a changing of the modifier value is beneficial. The alert message may be output by a user interface of the hearing device and/or the fitting device.

According to an embodiment, the modifier effectiveness value is determined from a spectrum of the audio signal. The audio signal received in the hearing device may be analyzed, whether a change of the modifier results in a perceptible change of the processed audio signal. For example, the modifier effectiveness value is determined from a level of the audio signal in a frequency band. Such a determination may be use ful for modifiers, which directly change the spectrum of the audio signal, such as a bass modifier or a treble modifier.

According to an embodiment, the method further comprises: classifying the audio signal by generating classification values, wherein the classification is performed by a classifier of the hearing device and the classification values identify and/or classify the current sound situation of a user of the hearing device. A classifier may be a program module and/or software function of the hearing device, in which the audio signal or a signal derived therefrom (such as a FFT transformed signal) is input and which outputs one or more values (called classification values), which indicate properties of the audio signal. Such properties may be a sound situation of the user. The classification may identify the current sound situation of the user, such as listening to speech, listening to music, wind noise, noisy environment, etc. Such sound situations may be classified with percentage values. The classification values may be percentage values and/or may classify the sound situation, in which the user is.

According to an embodiment, the modifier effectiveness value is calculated from the classification values and/or is such a classification value. For example, when the noise classifier puts out a noise classification value indicating that there is no noise in the audio signal, then the modifier effectiveness value also can be chosen low. The noise modifier effectiveness value may be the classification value of the noise classifier.

A classifier may be an algorithm or software module, for example run in the hearing device, based on machine learning, neuronal networks, deep neuronal networks, convolutional neuronal networks, big data and/or artificial intelligence.

According to an embodiment, classification values are sent to the fitting device. The classification values generated in the hearing device may be sent to the fitting device via a data communication connection. The inputting and/or changing of the modifier value may be restricted additionally in dependence of the classification values. The threshold modifier effectiveness value may be determined in dependence of the classification values.

According to an embodiment, the method further comprises: processing the audio signal with at least one sound program, thus providing a processed audio signal, wherein the at least one sound program is selected in dependence of the classification values. The sound program comprises parameters applied to the sound processor for processing the audio signal. The sound program may be defined via these parameters, which may be control parameter for actuators of the hearing device.

According to an embodiment, the modifier effectiveness value is determined based on the selected sound program. For example, when a noise canceling sound program is running, then it may be assumed that a noise canceling modifier has an perceptible effect on the output processed audio signal. The modifier effectiveness value may be calculated from the parameters applied to the sound processor.

The modifier effectiveness value based on a sound program may be dependent on a difference between the audio signal input into the sound program and the audio signal, which has been processed by the sound program. Such a modifier effectiveness value may indicate, how strong the sound program influences the processing of the audios signal, in particular in dependence of the one or more modifier values. Such a modifier effectiveness value may be an activity value of the sound program. A lower activity value may indicate that the sound program does modify the audio signal weaker. A higher activity value may indicate that the sound program modifies the audio signal stronger.

According to an embodiment, the audio signal is processed with a plurality of sound programs, wherein a mixing relation between the sound programs is determined in dependence of the classification values, wherein the audio signal processed by the plurality of sound programs is produced by mixing an output of the sound programs in dependence of the mixing relation. The mixing relation may comprise values, which may be percentage values, how strong one sound program influences the processing of the audio signal compared to another sound program.

The mixing relation may be sent to the fitting device and/or the changed modifier value may be restricted additionally in dependence of the mixing relation. For example, the threshold modifier effectiveness value may be determined in dependence of the mixing relation.

According to an embodiment, the sound program processes the audio signal in dependence of a plurality of actual modifier values, each actual modifier value associated with a specific modifier. Usually, there may be more than one modifier, which may be applied to the hearing device and/or which influence the sound processing and/or the sound programs.

According to an embodiment, at least one modifier value associated with one of the modifiers is changed with the fitting device in dependence of user input, wherein the fitting device restricts the changing of the at least one modifier value. A control element for at least some of the modifiers may be provided by the user interface of the fitting device.

According to an embodiment, the fitting device determines a threshold modifier effectiveness value for the at least one sound program in dependence of the specific modifier associated with the at least one modifier value. Optionally, threshold modifier effectiveness value may be determined, additionally in dependence of the classification values and/or the mixing relation. The changing of the at least one modifier value is restricted, when the modifier effectiveness value of the at least one sound program is smaller or higher than the threshold modifier effectiveness value.

According to an embodiment, the sound processor of the hearing device comprises several actuators and the audio signal is input into one or more of the actuators and is processed by the one or more actuators to process the audio signal. The sound processor of the hearing device may comprise several actuators, which may be under the control of one or more sound programs. A sound program also may be seen as a parameter set for one or more actuators. The audio signal may be input into one or more of the actuators and may be processed there. For example, a frequency dependent gain of the audio signal may be adjusted by the one or more sound programs. The sound programs and/or a mixing of the sound programs may be selected based on the classification performed by the hearing device. For example, in situations with high wind noise, a noise suppression may be increased.

According to an embodiment, the modifier effectiveness value is calculated from one or more control parameters of the one or more actuators. For example, when a sound cleaning actuator is running, it may be assumed that sound cleaning should be performed and a change of the associated modifier may result in a perceptible change of the processed audio signal.

It has to be noted that a changed modifier may change the control parameters of one or more actuators. The modifier valued may be used in the hearing device to calculated changed actuator control parameters. With respect to this, the modifier effectiveness value may be calculated from one or more control parameters of the one or more actuators, which control parameters are determined by the hearing device without considering modifier values.

Further aspects relate to a computer program for fitting a hearing device, which, when being executed by a processor, is adapted to carry out the steps of the method as described in the above and in the following as well as to a computer-readable medium, in which such a computer program is stored.

For example, the computer program may be executed in a processor of the hearing device and a processor of the fitting device. The computer program also may be executed in a mobile device carried by the user and/or a stationary fitting device, which may be situated in the office of a hearing care specialist.

The computer-readable medium may be a memory of the hearing device and a memory of the fitting device. It also may be that steps of the method are performed by the hearing device and other steps of the method are performed by the mobile device.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

Further aspects relate to a fitting system comprising a hearing device and a fitting device as described herein. The fitting system may be adapted for performing the method as described herein.

It has to be understood that features of the method as described in the above and in the following may be features of the computer program, the computer-readable medium and the fitting system as described herein, and vice versa.

These and other aspects will be apparent from and elucidated with reference to the embodiments described hereinafter.

FIG. 1 schematically shows a fitting system 10 with a hearing device 12 in the form of a behind-the-ear device and a fitting device 14. It has to be noted that the hearing device 12 is a specific embodiment and that the method described herein also may be performed by other types of hearing devices, such as in-the-ear devices.

The fitting device 14 may be a mobile device 14*a*, such as a smartphone, or a stationary fitting device 14*b*, such as a PC. The mobile device 14*a* may be carried by the user of the hearing device 12. The stationary fitting device 14*b* may be situated in the office of a hearing care specialist and may be operated by the hearing care specialist.

The hearing device 12 comprises a part 15 behind-the-ear and a part 16 to be put in the ear channel of a user. The part 15 and the part 16 are connected by a tube 18. In the part 15, a microphone 20, a sound processor 22 and a sound output device 24, such as a loudspeaker, are provided. The microphone 20 may acquire environmental sound of the user and may generate an audio signal, the sound processor 22 may amplify the audio signal and the sound output device 24 may generate sound that is guided through the tube 18 and the in-the-ear part 16 into the ear channel of the user.

The hearing device 12 may comprise a processor 26, which is adapted for adjusting parameters of the sound processor 22, such that a frequency dependent gain noise suppression, etc. For example, the audio signal may be analyzed and dependent thereon, sound programs, which adjust the sound processor 22 may be selected and/or mixed. Further adjustments may be made with a knob 28 of the hearing device 12. These functions may be implemented as computer programs stored in a memory 30 of the hearing device 12, which computer programs may be executed by the processor 22.

The hearing device 12 also comprises a sender/receiver 32 for in particular wireless data communication with the fitting device 14. The fitting device 14 comprises a user interface 34, which displays control elements 36, which may be used by the user or the hearing care specialist to change modifiers of the hearing device 12, as will be described below. Examples for modifiers are modifiers for an overall loudness, bass, treble, noise canceling, a beam former, etc.

Figure 2:
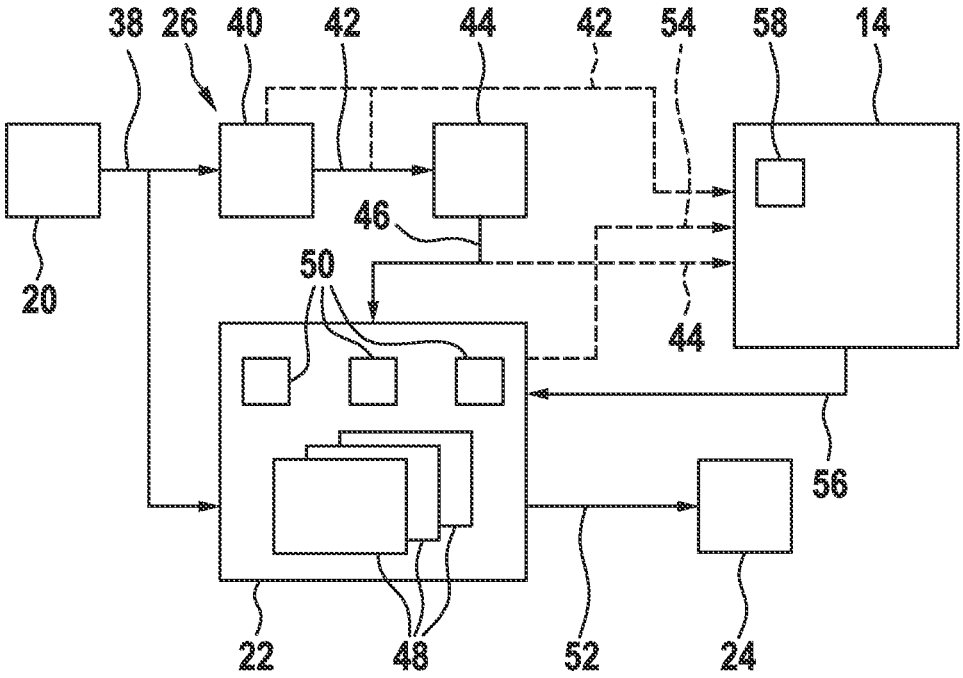
FIG. 2 schematically shows a functional diagram of a fitting system according to an embodiment.

FIG. 2 shows a functional diagram of the fitting system 10. The microphone 20 generates an audio signal 38, which is input into a classifier 40. The audio signal 38 also may be received by the sender/receiver 32, for example from the fitting device 14.

The classifier 40, which may be a computer program module run by the processor 26, generates classification values 42, which are input into a mixer 44, which generates mixing relations 46 from the classification values 42. Also the mixer 44 may be a computer program module run by the processor 26. The mixing relations 46 are used by the sound processor 22 to mix the output of sound programs 48.

The sound processor 22 processes the audio signal 38 with the aid of actuators 47. For example, there is an actuator 47 for frequency dependent attenuation, for noise canceling, for beam forming. In the hearing device 12 also sound programs 48 and modifier values 50 are stored in the hearing device 12. The sound programs 48 may be computer program modules that are at least partially run by the processor 26 and/or by the sound processor 22. It also may be that the sound programs comprise control parameter sets for the actuators 47, which are applied to the actuators 47, when the corresponding sound program is selected. With the sound processor 22 and in particular the actuators 47, a processed audio signal 52 is generated, which is output by the sound output device 24 to the user.

Some or all of the modifier values 50 may be input into the user interface 34 or changed therewith. The actually applied modifier values 50 may be sent to the fitting device 14 and may be displayed there in the use interface 34. When possible, i.e. when the changing of a modifier is not inhibited, a user may input a new modifier value 50 for one modifier and the corresponding modifier is sent to the hearing device 12 and applied to the sound processor 22.

The hearing device 12 is adapted for generating an modifier effectiveness value 54 for each or some of the modifiers associated with the respective modifier values 50. An modifier effectiveness value 54 indicates the amount of change of the audio signal 38 before and after its processing by the sound program 48, when the corresponding modifier value 50 is applied to the sound processing of the sound processor 22 of the actual audio signal 38. For example, when the actual audio signal 38 does not contain basses, the modifier effectiveness value 54 for the bass modifier is low or 0 and/or indicates that a modification of the basses of the audio signal is not sensible in the moment.

For example, the modifier effectiveness value 54 may be determined by the classifier 40. The classifier 40 may analyze, whether the audio signal 38 has a sound property, which is changed, when the modifier associated with the modifier effectiveness value 54 is changed. The modifier effectiveness value 54 may be determined from a level of the audio signal 38 in a frequency band. As a further example, the hearing device 12 may simulate the sound processing with a changed modifier value 50. The simulation result, i.e. a second processed audio signal can be compared with the processed audio signal 54, which is output to the user and the modifier effectiveness value 54 may be based on the comparison, such as the integral of the difference of the two signals.

The modifier effectiveness value 54 and optional further data generated in the hearing device 12 are sent to the fitting device 14. This further data may include the mixing relations 46, the classification values 42 and/or other data generated by the classifier 40, such as a spectrum of the audio signal 38.

As described above, with the fitting device 14, a modifier value 50 of the hearing device 12 can be changed. The fitting device 14 provides a control element 36 for the respective modifier, such as volume, noise suppression, a gain curve, etc. and a person, such as the user of the hearing device 12 and/or the hearing care specialist, may change the modifier value 50 with the control element 36. In the case when this is allowed, the changed modifier value 56 is sent to the hearing device 12, where the corresponding modifier value 50 is overwritten. After that, the sound processing is performed based on the changed modifier value 56.

Based on the modifier effectiveness values 54 for the modifiers (and optionally the received further data, such as the mixing relations 46 and/or the classification values 42), the fixing device 14 is adapted for restricting the inputting and/or changing of the modifier value 50.

Figure 3:
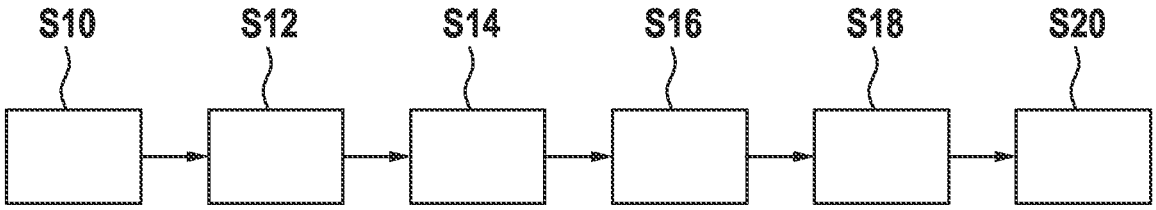
FIG. 3 shows a flow diagram for a fitting method according to an embodiment.

FIG. 3 shows a flow diagram for a method for fitting a hearing device 12, which may be performed by the fitting system shown in FIG. 1 and/or FIG. 2.

In step S10, the audio signal 38 is received in the hearing device 12 and the classifier 40 classifies the audio signal 38 by generating classification values 42. The classification values 42 may classify sound situations, such as speech-in-noise, music, noise-environment, wind noise, etc.

In an embodiment, the classifier 40 also generates one or more modifier effectiveness values 54 for one or more modifiers by directly analyzing the audio signal 38, for example by analyzing the spectrum of the audio signal 38.

In an embodiment, the classifier 40 generates one or more modifier effectiveness values 54 for one or more modifiers are calculated from classification values 42, which are used for selecting and/or mixing sound programs 48 (see below).

In step S12, the audio signal 38 is processed with sound processor 22 and the actuators 47. Hereto, the appropriately mixed sound programs 48 and the modifier values 50 are applied to the actuators 47. An active sound programs 48 may be selected in dependence of the classification values 42. The mixer 44 may determine a mixing relation 46 between the sound programs 48 in dependence of the classification values 42. For example, a noise suppression program 48 may have a higher influence on the audio signal 38, when a noise situation is detected by the classifier 40.

In an embodiment, the selected sound program or the mixing relation 46 may be used for calculating one or more modifier effectiveness values 54 for one or more modifiers. When the mixing relation 46 indicates that much noise canceling is activated then the for modifier effectiveness values 54 for a noise canceling modifier may indicate this.

In step S14, the processed audio signal 52 is output to a user of the hearing device 12 with the sound output device 24.

In step S16, the fitting device 14 receives modifier effectiveness values 54 for some or all of the modifiers, which can be changed with the user interface 34. As already mentioned, the modifier effectiveness values 54 may be determined indirectly from settings and/or parameters in the hearing device 12. The modifier effectiveness values 54 also may be determined by comparing the audio signal 38 before and after the processing.

As a further embodiment, it may be estimated for each sound program 48, how strong it changes the audio signal 38. Such a change may be determined with respect to volume and/or with respect to frequency.

In step S18, the fitting device 14 displays the user interface 34 and one or more control elements 36.

Figure 4:
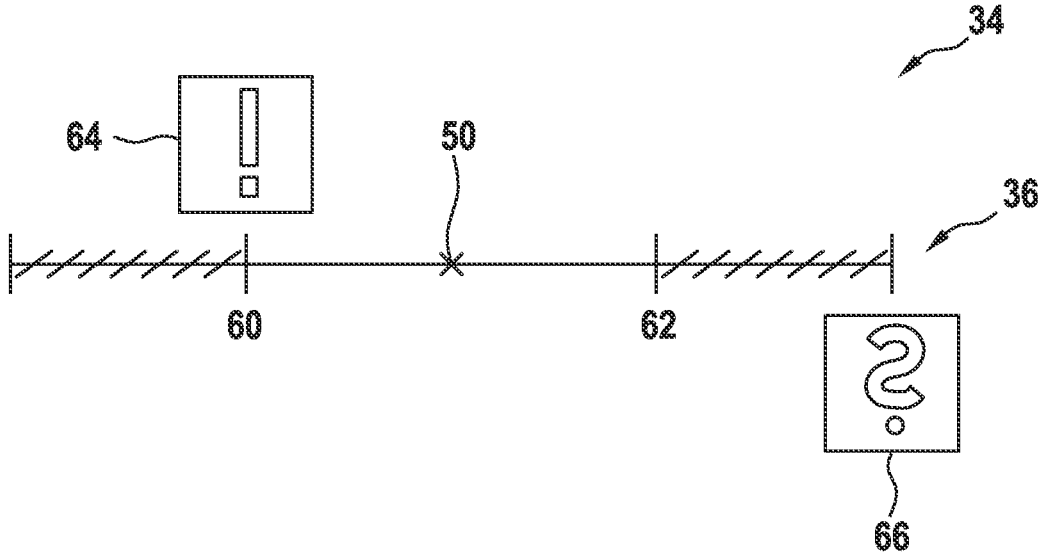
FIG. 4 schematically shows a control element for a fitting system according to an embodiment.

This is shown in FIG. 4, which shows a part of the user interface 34 with a control element 36 for a modifier with a single changeable modifier value 50. Examples for such a modifier are volume, bass, treble, noise suppression, etc. For example, the control element 36 is a slider.

The control element 36 may be adapted and/or deactivated based on the actual sound situation. To this end, a threshold modifier effectiveness value 58 (see FIG. 2) may be determined. The threshold modifier effectiveness value 58 may be stored in the fitting device 14 with respect to the modifier and/or may be determined based on data generated in the hearing device 12, such as the classification values 42 and/or the mixing relations 46. For example, in the case of a modifier, which has an influence on frequency compressing, the threshold modifier effectiveness value 58 may depend on a volume of the audio signal in the frequency band, which is frequency compressed.

When the modifier effectiveness value 54 is smaller or higher than the threshold modifier effectiveness value 58, the control element 36 may be adapted. For example, a possible range of modifier values 50 may be restricted or the control element 36 may be deactivated.

For example, based on the modifier effectiveness value 54 and optionally other data, such as the classification values 42 and/or the mixing relations 46, a possible range for the modifier value 50 is restricted by the control element 36. As shown, parts of the control element 36 outside of a minimal modifier value 60 and a maximal modifier value 62 cannot be reached.

It also may be that, when the modifier value 50, which is changed based on user input to the control element 36, is smaller than the minimal modifier value 60 and/or bigger than the maximal modifier value 62, the fitting system 14 outputs a warning message 64 on the user interface 34 that a change of the at least one modifier value 50 has presumably no perceptible effect on the sound processing of the sound program 48.

When the control element 36 is not deactivated at all, the modifier value 50 may be changed with the control element 36 in dependence of user input. In such a way, the fitting device 14 at least restricts the changing of the modifier value 50 in dependence of the modifier effectiveness value 54 and optionally, further data from the hearing device 12, such as the mixing relation 46 and/or the classification values 42.

In step S20, the fitting system 10 outputs an alert message 66, when the modifier effectiveness value 54 and the modifier value 50 indicate that a changing of the modifier value 50 results in a change of the modifier effectiveness value 54. This may be in particular the case, when the modifier effectiveness value 54 for the modifier is higher (or smaller) than the threshold modifier effectiveness value 58 determined for the modifier.

For example, the user or the hearing care specialist may have set a flag in the fitting device 14, that he or she wishes to adapt a specific modifier. When a sound situation is reached, where a changing of the modifier value results in a perceptible change in the processing of the audio signal 38, the alert message 66 may inform the user that changing the modifier value 50 may be beneficial.

Figure 5:
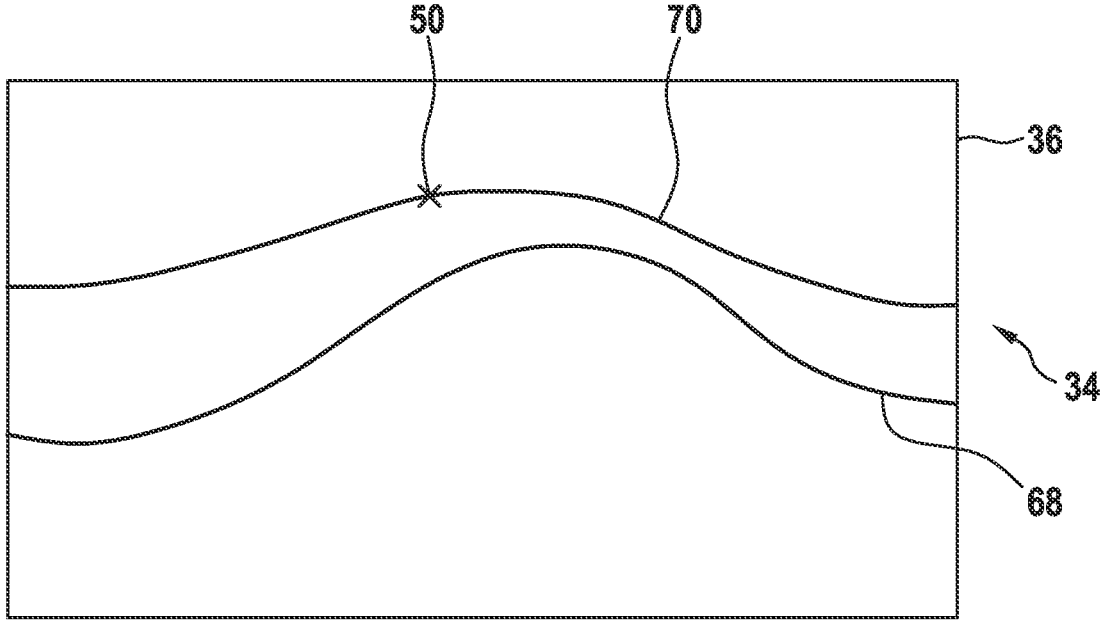
FIG. 5 schematically shows a control element for a fitting system according to a further embodiment.

FIG. 5 shows a further example of user interface 34 with a control element 36, which may be used for restricting a changing of modifier values 50. Here, an actual volume curve 68 and a volume restriction curve 70 are shown. The control element 36 may be shown on a stationary fitting device 14*b* and may be used by a hearing care specialist to adjust the volume restriction curve 70.

The volume restriction curve 70 (which may be seen as a special modifier) may be composed of a plurality of modifier values 50, each of which determines the maximal volume in a frequency band. The modifier effectiveness value 54 for this modifier may be determined from the actual volume in this frequency band. In particular, when the actual volume is much smaller than the maximal volume, the maximal volume should not be changed. In this case, the control element 36 may restrict a changing of the volume restriction curve 70 in this frequency band and/or may alert the person using the control element 36 that a change may not result in a perceptible differently processing of the audio signal 38.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 fitting system
12 hearing device
14 fitting device
14*a* mobile device
14*b* stationary fitting device
15 part behind the ear
16 part in the ear
18 tube
20 microphone
22 sound processor
24 sound output device
26 processor
28 knob
30 memory
32 sender/receiver
34 user interface
36 control element
38 audio signal
40 classifier
42 classification values
44 mixer
46 mixing relation
47 actuator
48 sound program
50 modifier value
52 processed audio signal
54 modifier effectiveness value
56 changed modifier value
58 threshold modifier effectiveness value
60 minimal modifier value
62 maximal modifier value
64 warning message
66 alert message
68 volume curve
70 volume restriction curve

What is claimed is:

1. A method for fitting a hearing device with a fitting device, the method comprising:

receiving an audio signal in the hearing device;

providing a user interface for inputting at least one modifier value into the fitting device, the at least one modifier value indicating how a sound property of the audio signal should be modified by the hearing device;

processing the audio signal with a sound processor of the hearing device in dependence of the at least one modifier value, thus providing a processed audio signal;

outputting the processed audio signal to a user of the hearing device;

classifying the audio signal by generating classification values, wherein the classification is performed by a classifier of the hearing device and the classification values identify and classify a current sound situation of the user of the hearing device;

determining a modifier effectiveness value based on the audio signal by at least one of the hearing device or the fitting device, the modifier effectiveness value indicating how much a change of the at least one modifier value results in a perceptible change of the processed audio signal output to the user, wherein the modifier effectiveness value is calculated from the classification values; and restricting the inputting of the at least one modifier value in dependence of the modifier effectiveness value.

2. The method of claim 1, wherein the user interface is configured such that solely a modifier value selected from a predefined set or a predefined set of modifier values can be input; and wherein the inputting of the at least one modifier value is restricted to a subset or a subrange of the predefined set of modifier values.

3. The method of claim 2, wherein the inputting of the at least one modifier value is restricted by turning off the user interface for inputting the modifier value.

4. The method of claim 1, wherein a set of modifier values is determined for which a change results in a perceptible change of the processed audio signal output to the user; and wherein, when a modifier value input into the user interface is not in the set of modifier values, the fitting device outputs a warning message that a change of the at least one modifier value has no perceptible effect on sound processing of a sound program.

5. The method of claim 1, wherein the fitting device outputs an alert message when the modifier effectiveness value and the at least one modifier value indicate that a changing of the at least one modifier value results in a perceptible effect on sound processing of a sound program.

6. The method of claim 1, wherein the modifier effectiveness value is at least one of:

determined from a spectrum of the audio signal; or determined from a level of the audio signal in a frequency band.

7. The method of claim 1, further comprising:

processing the audio signal with at least one sound program, wherein the at least one sound program is selected in dependence of the classification values and comprises parameters applied to the sound processor for processing the audio signal.

8. The method of claim 7, wherein the modifier effectiveness value is at least one of:

determined based on the selected sound program; or calculated from the parameters applied to the sound processor.

9. The method of claim 1, wherein the sound processor of the hearing device comprises several actuators and the audio signal is input into one or more actuators of the several actuators and is processed by the one or more actuators; and wherein the modifier effectiveness value is calculated from one or more control parameters of the one or more actuators.

10. The method of claim 1, wherein the fitting device is a mobile device carried by the user; or wherein the fitting device is a stationary device of a hearing care specialist.

11. A computer program product embodied in a non-transitory computer-readable medium and comprising computer instructions for performing a process for fitting a hearing device, the process comprising:

receiving an audio signal in the hearing device;

providing a user interface for inputting at least one modifier value into a fitting device, the at least one modifier value indicating how a sound property of the audio signal should be modified by the hearing device;

processing the audio signal with a sound processor of the hearing device in dependence of the at least one modifier value, thus providing a processed audio signal;

outputting the processed audio signal to a user of the hearing device;

classifying the audio signal by generating classification values, wherein the classification is performed by a classifier of the hearing device and the classification values identify and classify a current sound situation of the user of the hearing device;

determining a modifier effectiveness value based on the audio signal by at least one of the hearing device or the fitting device, the modifier effectiveness value indicating how much a change of the at least one modifier value results in a perceptible change of the processed audio signal output to the user, wherein the modifier effectiveness value is calculated from the classification values; and restricting the inputting of the at least one modifier value in dependence of the modifier effectiveness value.

12. A fitting system comprising a hearing device and a fitting device, wherein the fitting system is configured to perform a process comprising:

receiving an audio signal in the hearing device;

providing a user interface for inputting at least one modifier value into the fitting device, the at least one modifier value indicating how a sound property of the audio signal should be modified by the hearing device;

processing the audio signal with a sound processor of the hearing device in dependence of the at least one modifier value, thus providing a processed audio signal;

outputting the processed audio signal to a user of the hearing device;

classifying the audio signal by generating classification values, wherein the classification is performed by a classifier of the hearing device and the classification values identify and classify a current sound situation of the user of the hearing device;

determining a modifier effectiveness value based on the audio signal by at least one of the hearing device or the fitting device, the modifier effectiveness value indicating how much a change of the at least one modifier value results in a perceptible change of the processed audio signal output to the user, wherein the modifier effectiveness value is calculated from the classification values; and restricting the inputting of the at least one modifier value in dependence of the modifier effectiveness value.

* * * * *